United States Patent [19]

Kaku et al.

[11] 4,154,900

[45] May 15, 1979

[54] COMPOSITE MATERIAL OF FERROUS CLADDING MATERIAL AND ALUMINUM CAST MATRIX AND METHOD FOR PRODUCING THE SAME

[75] Inventors: Yoshihiro Kaku; Kiyotaka Hiraoka, both of Toyota; Mikio Sugiura, Okazaki; Yoshio Kato, Toyota, all of Japan

[73] Assignee: Taiho Kogyo Co., Ltd., Toyota, Japan

[21] Appl. No.: 796,196

[22] Filed: May 12, 1977

[30] Foreign Application Priority Data

May 14, 1976 [JP] Japan ..... 51-55056

[51] Int. Cl.[2] ..... B22F 3/00

[52] U.S. Cl. ..... 428/554; 428/559; 428/608; 428/609; 428/567; 427/203; 427/205; 427/328; 427/329

[58] Field of Search ..... 427/203, 205, 328, 329; 428/559, 554, 608, 609, 567

[56] References Cited

U.S. PATENT DOCUMENTS

| | | | |
|---|---|---|---|
| 2,127,207 | 8/1938 | Curtin | 428/559 |
| 2,241,095 | 5/1941 | Marvin | 427/205 |
| 2,580,652 | 1/1952 | Brennan | 427/205 |
| 2,714,246 | 8/1955 | Coffman et al. | 428/559 |
| 3,139,671 | 7/1964 | Herron et al. | 428/554 |
| 3,708,322 | 1/1973 | Jackson et al. | 427/205 |
| 3,813,266 | 5/1974 | Porta et al. | 427/205 |

FOREIGN PATENT DOCUMENTS

| | | | |
|---|---|---|---|
| 1817038 | 8/1969 | Fed. Rep. of Germany | 428/554 |

*Primary Examiner*—Brooks H. Hunt

*Attorney, Agent, or Firm*—Blanchard, Flynn, Thiel, Boutell & Tanis

[57] ABSTRACT

A composite material of a ferrous cladding material and an aluminum cast matrix which composite material exhibits excellent performance and a method for producing the same which can be carried out quite easily. The composite material comprises a ferrous cladding material, powder particles bonded to the ferrous cladding material, seizing portions defined by the powder particles, and a cast matrix of aluminum or its alloy held by the seizing portions. The method comprises the steps of spreading powder particles over a ferrous cladding material, bonding the powder particles to the ferrous cladding material by sintering, and casting aluminum or its alloy over the sintered surface. Further, a metallic layer can be formed between the bonded powder particles and the cast aluminum, by plating.

16 Claims, 4 Drawing Figures

COMPOSITE MATERIAL OF FERROUS CLADDING MATERIAL AND ALUMINUM CAST MATRIX AND METHOD FOR PRODUCING THE SAME

BACKGROUND OF THE INVENTION

This invention relates to a composite material which comprises an aluminum cast matrix and a metal cladding material, and method for producing the same. More particularly, the invention relates to a composite material comprised of an aluminum cast matrix and a ferrous cladding material and a method for producing the same, in which a powder of iron or its alloy, or copper or its alloy, or mixture thereof is joined to the surface if a ferrous cladding material by sintering and aluminum or its alloy is cast on the sintered surface.

A composite material made of an aluminum or aluminum alloy matrix and a ferrous metal bonded to the matrix, is generally used, for example, for making cylinders of internal combustion engines and brake drums in which aluminum or its alloy alone can not withstand the severe conditions and ferrous metal alone provides its problems of its weight and cost. As the method for joining a different kind of metal to the matrix of aluminum or its alloy, there are known in the prior art a method in which the surfaces to be joined are made jagged and they are mechanically joined together, the Al-Fin process which utilizes a chemically joining force, the transplanting process which utilizes molten jet layers, and so forth.

In the Al-Fin process, however, the pretreatment of the ferrous material is complicated. In addition, the casting must be done while the aluminum is molten or with the melting of aluminum since molten aluminum must be used. Thus, the production process becomes very complicated and it is difficult to obtain stable quality products. Further, an aluminum-iron alloy is liable to be formed on the joined surfaces and this aluminum-iron alloy is brittle so that a sufficient bonding strength can not be maintained under some conditions and the product can not be used under conditions in which a large thermal load and impacts are applied therein.

In the transplanting process, a large number of steps are required since molten jet layers are utilized. In addition, iron oxide is intermixed during the step of applying the molten jets so that the machining after such step becomes quite difficult. Further, the thermal conductivity of iron oxide is very low so that, when the products are used as parts which receive a large thermal load, a satisfactory result can not be expected. These have been the problems remaining to be solved in the conventional art.

Still further, in the method utilizing the mechanical joining of jagged surfaces, the bonding strength is not satisfactory when simple rough surfaces are mechanically joined together. In order to improve the joining strength, therefore, several methods are proposed, for example, a method of pressing and enlarging the projections on the joining surface into a mushroom-shape, or a method of plating the joining surfaces with zinc so as to effect diffision bonding, or a method utilizing both the above methods. In these methos, however, the deformation of the projections is difficult and when plating is employed, the difficulties in process control and environmental pollution become problems. Furthermore, since the projections formed on the surface to be joined become lage in such methods, they can not be employed for joining relatively thin ferrous cladding materials. On the other hand, if thicker materials are used, the weights of the parts become large so that it is not suitable for making lightweight parts.

BRIEF SUMMARY OF THE INVENTION

It is therefore an object of the present invention to provide an improved composite material and a method for producing the same which possesses certain novel advantageous features overcoming the above-described negative aspects of prior art methods.

Another object of the present invention is to provide an improved composite material consisting of an aluminum cast matrix and a ferrous cladding material, which is light in weight but large in shearing strength and which can be made quite easily.

A further object of the present invention is to provide an improved method for producing the composite material of the type described above, which method can be carried out without excessive cost and difficulty.

In accordance with the present invention, the composite material comprises a ferrous cladding material; powder particles of iron or its alloy, or copper or its alloy, or mixture thereof in which the powder particles are tightly bonded to the surface of the above ferrous cladding material by sintering; seizing portions defined by the powder particles; and a cast matrix of aluminum or its alloy having seizing portions which are caught by the above seizing portions formed among the powder particles. Further, a metallic plated layer can be interposed between the seizing portions on the ferrous cladding material and the seizing portions on the cast matrix.

Further, the above-mentioned method of the present invention for producing the composite material of a ferrous cladding material and an aluminum cast matrix comprises the steps of spreading quite thinly the powder particles of iron or its alloy, copper or its alloy, or mixture thereof on the surface of a ferrous cladding material; then bonding the powder particles tightly to the surface of the ferrous cladding material by means of sintering; and casting aluminum or its alloy as a cast matrix over the sintered surface. According to another aspect of the present invention, a metal having diffusibility is plated over the above sintered surface before the cast aluminum matrix is applied.

BRIEF DESCRIPTION OF THE DRAWINGS

These and other objects and features of the present invention will become more apparent to those skilled in the art from the following description taken in connection with the accompanying drawings, in which.

DESCRIPTION OF PREFERRED EMBODIMENTS

Referring now to the accompanying drawings, the composite material and the method for producing the same will be described in the following. For reference purpose, an example of a composite material made by a conventional prior art method will be briefly described.

Figure 1:
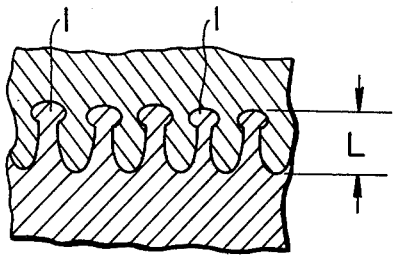
FIG. 1 is a vertical cross-sectional view, on an enlarged scale, of a composite material made by a conventional method.

In one known method, the surface of the cladding material or backing sheet material is provided with a large number of projections 1 as shown in FIG. 1. The tip ends of the projections are deformed or flattened so as to increase the bonding force. However, this operation has been somewhat difficult. Further, the thickness L of the projections 1 is liable to become large so that this method can not be employed for relatively thin materials. If the thickness of the cladding material is increased, the weight of the product also becomes large, which can not be accepted when lightweight parts are required. In another conventional method, a metallic layer such as a layer of zinc, is applied to the surface to be joined by plating, or the above deformation of the projections and the plating are employed in combination. However, several problems such as the difficulty of process control and environmental pollution have not been avoided.

In view of the above and the previously described disadvantages of the conventional methods, the inventors of the present application have carried out various studies and experiments, and as the result, the present invention has been accomplished, which will be described in detail hereinafter.

Figure 2:
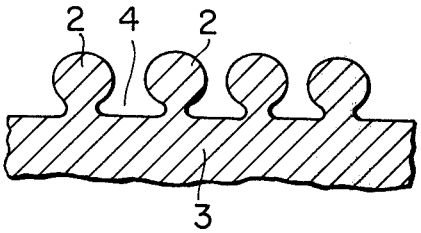
PRIOR ART FIG. 2
FIG. 2 is a schematic vertical cross-sectional view, on an enlarged scale, of an embodiment of the ferrous cladding material of the present invention, in which powder particles are bonded to the surface of the material by sintering.

As shown in FIG. 2, the surface of the ferrous cladding material 3 is provided with a plurality of particles 2 which are tightly bonded to the material 3 by sintering. Between the particles 2 there are a plurality of seizing portions or undercut cavities 4, which the aluminum or aluminum alloy cast over the ferrous cladding material can be firmly grasped to prevent separation.

In addition to the above mechanical bonding, since a sintered plate is used, the diffusion reaction between the sintered metallic powder and the aluminum or its alloy takes place and a strong metal-to-metal bond can be formed. In this case, while the diffusion occurs partially by die casting, a full diffusion reaction can be attained by metal-mold casting so that, with the double effect of the above mechanical bonding of the seizing portions 4 and the diffusion, quite strong joining can be attained.

Further, after the powder is bonded to the surface of the ferrous cladding material by sintering, the sintered surface may be plated with a metal having diffusivity such as copper and zinc, and then aluminum or aluminum alloy is cast over the plated surface. With this process, the diffusion occurs all over the joined surface and an advantageous chemical bonding can be obtained.

The factors that influence the bonding strength are as follows:

(1) The diameter of the powder particles.

(2) The shape of the powder particles.

(3) The kind of the powder particles.

(4) The density of distribution of the powder particles.

(5) The conditions of sintering.

Each of these factors will be explained. When the particle diameter is large, both the tensile strength and shearing strength become large. Therefore, the particle size may be determined in accordance with the condition of use. The particle size is in the range of 40 to 150 mesh. In view of the shapes of the particles, an atomized powder (spherical) is preferable to ground powder. Since the shapes of ground powder particles are irregular, an even bonding strength can not be obtained, whereas the atomized powder particles are spherical, so that uniform and full bonding areas are created and the bonding strength of individual particles is large.

With regard to the kind of powder particles given in the above item (3), diffusible metals must be selected since they influence the metallurgical bonding strength between the aluminum or its alloy, ferrous cladding material and the powder particles. Accordingly, in the present invention, the powder particles of iron or its alloy, or copper or its alloy, or suitable mixture thereof are used because they are diffusible with aluminum or its alloy, easily bonded to ferrous materials by sintering, and exhibit large bonding strength when they are sintered.

In connection with the density of distribution the powder particles given in the item (4), when the powder particles are applied in many layers, the bonding force between the particles becomes weak and, when aluminum or its alloy is cast thereon, it becomes hard for the aluminum or its alloy to enter the spaces between the particles. Therefore, the powder particles are most preferably arranged in a single layer on the ferrous cladding material. Further, even when the powder particles are arranged in a single layer, the dimensions of the spaces among the arrayed powder particles are important. That is, when the spaces are narrow, the cast metal hardly enters the spaces and the sintered layer is not sufficiently filled with the cast metal, therefore the bonding strength between the sintered plate and the cast metal becomes low. In addition, a layer of air remains between the sintered plate and cast metal so that the thermal conductivity between the ferrous cladding material and the cast metal becomes low.

For such reason, the density and the state of distribution of the powder particles must be precisely controlled with great care. More particularly, the powder particles must be spread in consideration of the sizes, shapes and the above spacing of the particles.

With regard to the condition of sintering in item (5), it has a great influence on the bonding strength between the ferrous cladding material and the powder particles, which also has an effect on the bonding strength between the ferrous cladding material and the cast metal. In other words, the bonding strength between the ferrous cladding material and the cast metal depends upon the sufficiency of the diffusion reaction between them. Generally speaking, the longer is the time of sintering, the more sufficient is the diffusion reaction. However, when the sintering time is too long, the seizing portions 4 among the powder particles become small, so that an appropriate sintering condition must be determined.

Figure 3:
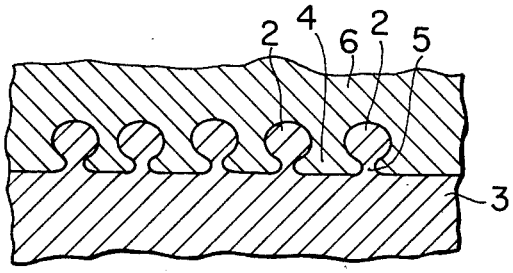
FIG. 3 is a schematic vertical cross-sectional view, also on an enlarged scale, of the composite material of the present invention.

The ferrous cladding material prepared according to the above process is then set into a die or a metal mold, and casting of aluminum of its alloy is carried out over the seizing portions of the ferrous cladding material. Thus, as shown in FIG. 3, the seizing portions 4 are filled with the cast metal 6 and the cast metal 6 is firmly captured by the seizing portions 4 thereby complimentary seizing portions which are integral with the cast metal. Therefore, the ferrous cladding material 3 can be tightly secured to the cast metal 6.

The preferable conditions in the above process may be understood from the following examples of the present invention. In compliance with the purpose of use, carbon steel (low carbon steel is preferable so as to increase the bonding strength between the powder particles) or special steel is selected as the ferrous cladding material. The thickness of the material may also be determined according to the use of the product.

EXAMPLE 1

The surface of a ferrous cladding material was subjected to sanding and an atomized powder of bronze having particle sizes of 80–145 mesh was spread over the surface of the ferrous cladding material to form a single layer of particles. Then a sintered plate was obtained by heating the above ferrous cladding material at 760°–820° C. for about 10 minutes in a hydrogen atmosphere. Test pieces were stamped out from the thus obtained plate by using a mechanical press and the test pieces were put in die casting molds. The die casting was carried out by using aluminum alloy. The used aluminum alloy was ADC 12 corresponding to ASTM SC114A, having the composition of Cu: 2.0–4.5%, Si: 10.5–12.0%, Mg:<0.3%, Zn:<1.0%, Fe:<1.3%, Mn:<0.5%, Ni:<0.5%, Sn:<0.35%, and Al: remainder.

EXAMPLE 2

A 3:1 mixture of 40–80 mesh atomized powder of bronze and an iron alloy was prepared and the mixture was applied over the surface of a low carbon steel plate, in which the surface of the plate was previously subjected to sanding. Then, it was heated to 850°–950° C. for about 10 minutes in a hydrogen atmosphere to obtain a sintered plate. Test pieces of proper sizes were stamped out from this plate by using a press and they were placed in certain portions of metal molds. Then an aluminum alloy was cast. The used aluminum alloy was AC 5A having the composition of Cu: 3.5–4.5%, Si:<0.6%, Mg: 1.2–1.8%, Zn:<0.1%, Fe:<0.8%, Mn:<0.1%, Ni: 1.7–2.3%, Ti:<0.2%, and Al: remainder.

EXAMPLE 3

The sintered plate obtained in the foregoing Example 1 was plated with a zinc layer of 15 microns thickness and it was put in metal mold, then casting was carried out by using an aluminum alloy (AC 5A) of the same kind as that used in Example 2.

As shown in FIG. 3, in the composite material obtained in Example 1, the bronze powder particles 2 are tightly bonded to the surface of the ferrous cladding material 3 at the contact portions 5, and at the same time, the seizing portions 4 are defined between the particles 2. The cast aluminum alloy 6 flows into the seizing portions 4 to fill up them. Therefore, the ferrous cladding material 3 and the cast aluminum 6 used as the cast matrix can be tightly bonded mechanically. During this process, the diffusion reaction between the powder particles 2 and the cast aluminum alloy 6 occurs especially in the layer of powder particles 2 to bring about chemical bonding. This diffusion effect is noteworthy in Example 2 as compared with Example 1.

Further in Example 3, the above diffusion is brought about all over the sintered plate to provide excellent bonding with both the mechanical and chemical actions.

Further, in the composite materials obtained in the above Examples, since the powder particles 2 are bonded to the surface of ferrous cladding materials 3 as shown in FIG. 3, the surface areas of the ferrous cladding materials 3 are increased several times as compared with the original surface areas. Therefore, when the products are used as parts for receiving thermal load, excellent thermal conduction from the ferrous cladding materials to the aluminum alloy can be expected. In addition, since bronze powder is used as the sintering powder, quite good thermal conductivity and high efficiency of thermal elimination can be attained.

Figure 4:
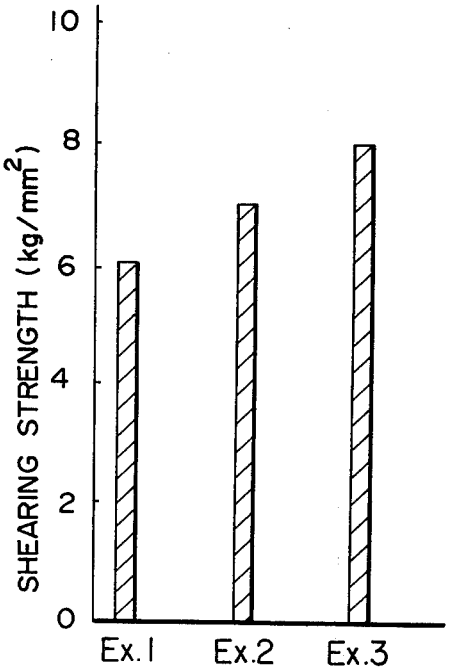
FIG. 4 is a graphical representation of the shearing strengths of the composite materials the following Examples 1, 2 and 3 of the present invention.

The bonding strength of the composite materials obtained in the above Examples 1, 2 and 3 were tested in view of shearing strengths, the results of which are shown in FIG. 4.

As will be understood from the results, the shearing strengths of the composite materials of the present invention may compare favorably with those made by the conventional methods and they may fully meet the requirements for practical use.

As described above, an excellent composite material having good mechanical and chemical bonding and good heat releasing property can be obtained by bonding the powder particles of iron or its alloy, or copper or its alloy, or mixture thereof to the surface of a ferrous cladding material and casting aluminum or its alloy over it. Further, by the provision of a plated metallic layer on the sintered plate, the chemical bonding effect can be much improved. Accordingly, the composite material of the present invention can be used as an industrial material when impact resistance and wear resistance in a high temperature condition are required, such as those for internal combustion engines. In addition, the method for producing the composite material of the present invention is quite easy as compared with the conventional methods.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. A composite article consisting essentially of:

a ferrous cladding member;

a single layer of a single thickness of spaced-apart generally spherical particles tightly bonded to the surface of said ferrous cladding member by sintering, said particles having a particle size in the range of from 40 to 150 mesh and being made or iron, iron alloy, copper, copper alloy or mixture thereof, said particles being located so as to define undercut cavities therebetween; and a cast matrix of aluminum or aluminum alloy solidified from the molten state while in contact with said particles and said cladding member, said cast matrix filling said undercut cavities and also defining a surface layer covering said particles.

2. A composite article as claimed in claim 1 in which said particles are made of iron, bronze or mixture thereof.

3. A composite article as claimed in claim 1 in which said ferrous cladding member is made of steel.

4. A composite article consisting essentially of:

a ferrous cladding member;

a single layer of a single thickness of spaced-apart generally spherical particles tightly bonded to the surface of said ferrous cladding member by sintering, said particles having a particle size in the range of from 40 to 150 mesh and being made of iron, iron alloy, copper, copper alloy or mixture thereof, said particles being located so as to define undercut cavities therebetween;

a thin layer of metal plated on said particles and the surface of said ferrous cladding member and diffused therein; and a cast matrix of aluminum or aluminum alloy solidified from the molten state while in contact with said thin layer, said cast matrix filling said undercut cavities and also defining a surface layer covering said particles and said thin layer.

5. A composite article as claimed in claim 4 in which said particles are made or iron, bronze or mixture thereof.

6. A composite article as claimed in claim 4 in which said ferrous cladding member is made of steel.

7. A composite article as claimed in claim 4 in which said thin layer is made of copper or zinc.

8. A method for producing a composite article of a ferrous cladding member and a cast aluminum matrix, consisting essentially of the steps of:

spreading a single layer of a single thickness of generally spherical particles in spaced-apart relation on the surface of a ferrous cladding member, said particles having a particle size in the range of from 40 to 150 mesh and being made of iron, iron alloy, copper, copper alloy or mixture thereof, said particles being located so as to define undercut cavities therebetween;

sintering the assembly of said ferrous cladding member and said particles to tightly bond said particles to the surface of said ferrous cladding member;

casting molten aluminum or molten aluminum alloy onto the sintered assembly of said ferrous cladding member and said particles to fill said undercut cavities and to form a surface layer covering said particles and then solidifying said molten aluminum or molten aluminum alloy.

9. A method according to claim 8 in which said particles are made of iron, bronze or mixture thereof.

10. A method according to claim 8 in which said ferrous cladding member is made of steel.

11. A method according to claim 8 in which said casting step comprises placing said sintered assembly in a metal mold and die casting said molten aluminum or molten aluminum alloy.

12. A method for producing a composite article of a ferrous cladding member and a cast aluminum matrix, consisting essentially of the steps of:

spreading a single layer of a single thickness of generally spherical particles in spaced-apart relation on the surface of a ferrous cladding member, said particles having a particle size in the range of from 40 to 150 mesh and being made of iron, iron alloy, copper, copper alloy or mixture thereof, said particles being located so as to define undercut cavities therebetween;

sintering the assembly of said ferrous cladding member and said particles to tightly bond said particles to the surface of said ferrous cladding member;

plating a thin layer of diffusible metal on said particles and the surface of said ferrous cladding member;

casting molten aluminum or molten aluminum alloy onto the assembly of said ferrous cladding member, said particles and said plated layer to fill said undercut cavities and to form a surface layer covering said particles and said plated layer and then solidifying said molten aluminum or molten aluminum alloy.

13. A method according to claim 12 in which said particles are made of iron, bronze or mixture thereof.

14. A method according to claim 12 in which said ferrous cladding member is made of steel.

15. A method according to claim 12 in which said casting step comprises placing said sintered assembly in a metal mold and die casting said molten aluminum or molten aluminum alloy.

16. A method according to claim 12 in which said thin plated layer is made of zinc or copper.

* * * * *